United States Patent [19]

Badoureaux et al.

[11] 4,256,018

[45] Mar. 17, 1981

[54] RADIAL PISTON FLUID ENGINE

[75] Inventors: Jean-Pierre Badoureaux; Jean-François Cheylus, both of Compiegne, France

[73] Assignee: Poclain Hydraulics, Verberie, France

[21] Appl. No.: 29,750

[22] Filed: Apr. 12, 1979

[30] Foreign Application Priority Data

May 22, 1978 [FR] France ..... 78 15070

[51] Int. Cl.[3] ..... F01B 13/06

[52] U.S. Cl. ..... 92/58; 91/491; 92/148

[58] Field of Search ..... 92/148, 12.1, 58, 72; 91/491

[56] References Cited

U.S. PATENT DOCUMENTS

| | | |
|---|---|---|
| 2,553,063 | 5/1951 | Simpson . |
| 3,092,037 | 6/1963 | Rhodes . |

FOREIGN PATENT DOCUMENTS

| | | |
|---|---|---|
| 602974 | 9/1934 | Fed. Rep. of Germany . |
| 372703 | 2/1906 | France . |
| 405171 | 7/1909 | France . |
| 1249873 | 11/1959 | France . |
| 2025354 | 7/1969 | France . |
| 1391592 | 4/1975 | United Kingdom . |

*Primary Examiner*—Abraham Hershkovitz
*Attorney, Agent, or Firm*—Lewis H. Eslinger

[57] ABSTRACT

The invention relates to an engine with radial pistons 9, which are coupled to elastic return means 25 for free-wheeling operation.

Said elastic means are constituted by springs 25 whose number is equal to that of the pistons and by levers 21 mounted to pivot, each with respect to a piston 9, about an axis parallel to the axis of rotation 6 of the cylinder block 7, and equal in number to the springs, whereas each spring 25 is coupled to two levers 21, each lever constituting the bond for two springs 25.

An application is the production of a hydraulic engine which is reliable and of simple design.

6 Claims, 4 Drawing Figures

RADIAL PISTON FLUID ENGINE

Radial piston engines are known, which are provided with a device permitting to fit the pistons in retracted position within their respective cylinders, and thus selectively, to make it so that the said pistons and the mobile trains to which they are coupled are no longer working during the so-called declutching and free-wheeling periods.

One of these known devices consists in enclosing the said pistons in one resilient ring, which returns the said pistons towards the centre of the engine when the cylinders are no longer fed in pressurized fluid. Although in theory this particular arrangement is satisfactory, on the practical side, it seems hardly feasible. Indeed, on the one hand, the single ring works permanently at a considerable rate, and eventually gets damaged, and on the other hand, the said ring is not easy to produce.

It is the object of the invention to overcome these disadvantages by being relative to pressurized fluid engines, such as hydraulic engines, constituted by:

a cam comprising at least one wave, a cylinder block mounted for rotation about an axis with respect to the said cam and comprising a plurality of cylinders arranged radially with respect to the axis of rotation, a plurality of pistons, one of which is slidably mounted in each cylinder and is capable of bearing against the cam, for example under the effect of the feeding pressurized fluid, and, an elastic device for returning the said pistons to a retracted position inside their respective cylinders, which device comprises a number of draw-springs which is at least equal to the number of pistons.

The elastic return device is also provided with levers mounted to pivot, each with respect to one piston, about an axis which is parallel to the axis of rotation of the cylinder block, and equal in number to the springs, whilst each lever constitutes the bond between two springs and each spring is coupled to two levers.

It is advantageous to adopt one or more of the following arrangements:

each spring is coupled to the levers corresponding to two successive pistons;

the pistons being supported by the cam by means of the girders on which they rest, rollers being mounted to rotate on the said girders and being adapted to be in running support on the said cam, circular grooves are provided at the ends of the girders. The levers are constituted by disks in which a circular opening is provided whose diameter is at least equal to that of the outer edge defining each groove, the said ends of the girders being introduced into the said openings and part of each disk bordering the corresponding opening which is itself introduced into one of the said grooves;

each disk comprises a hole, which is separate from the said opening and constitutes a hooking ring for the ends of two springs coupled thereto;

said hole is oblong and extends at substantially right angles with a plane crossing the axis of rotation of the cylinder block.

The invention will be better understood, and secondary characteristics and their advantages will become obvious from the following description of one embodiment given by way of example.

Reference will be made to the accompanying drawings in which.

Figure 1:
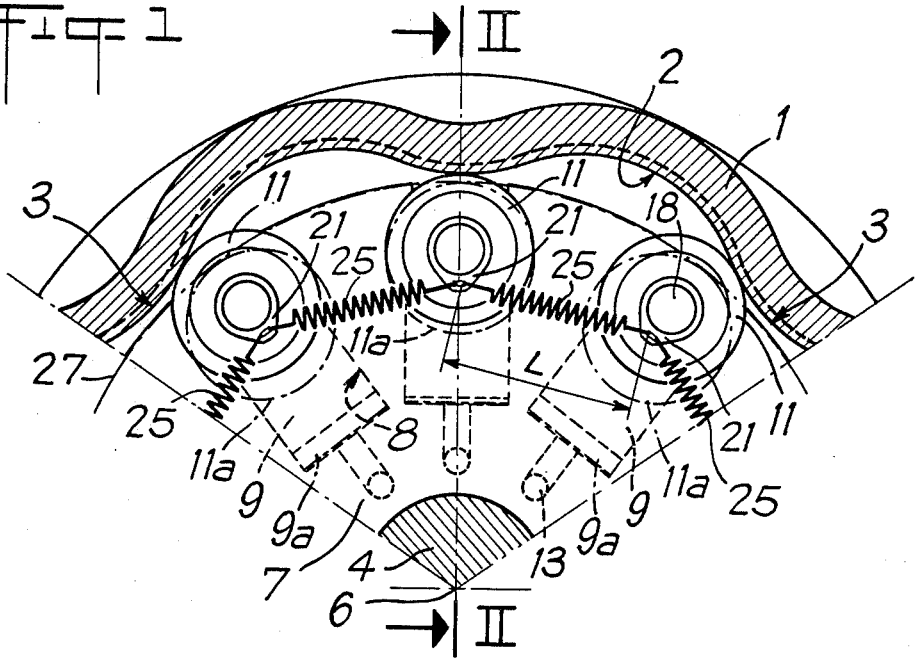
FIG. 1 is a partial cross-section along I—I of FIG. 2, of an engine according to the invention.
Figure 2:
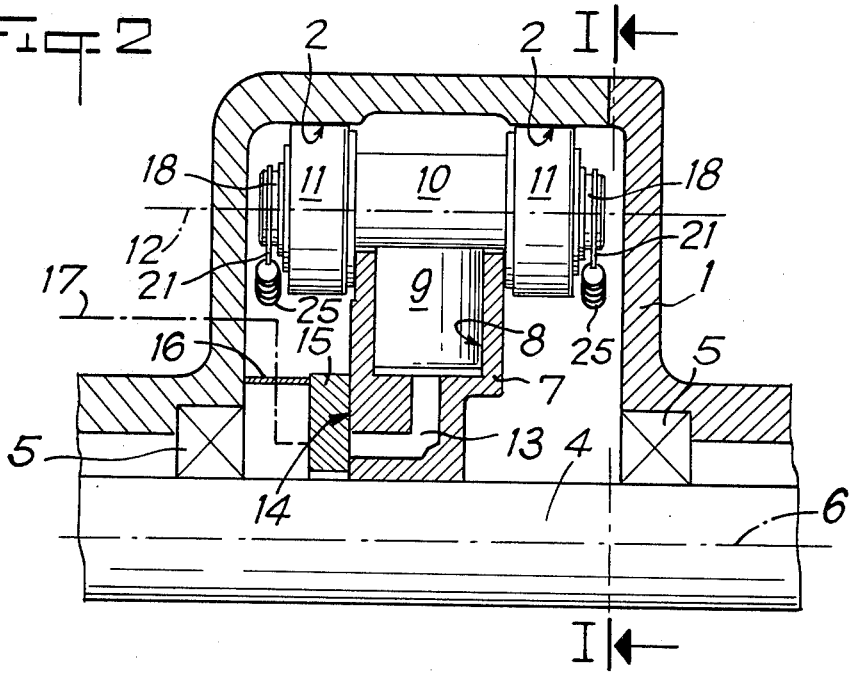
FIG. 2 is a cross-section along II—II of FIG. 1.
Figure 3:
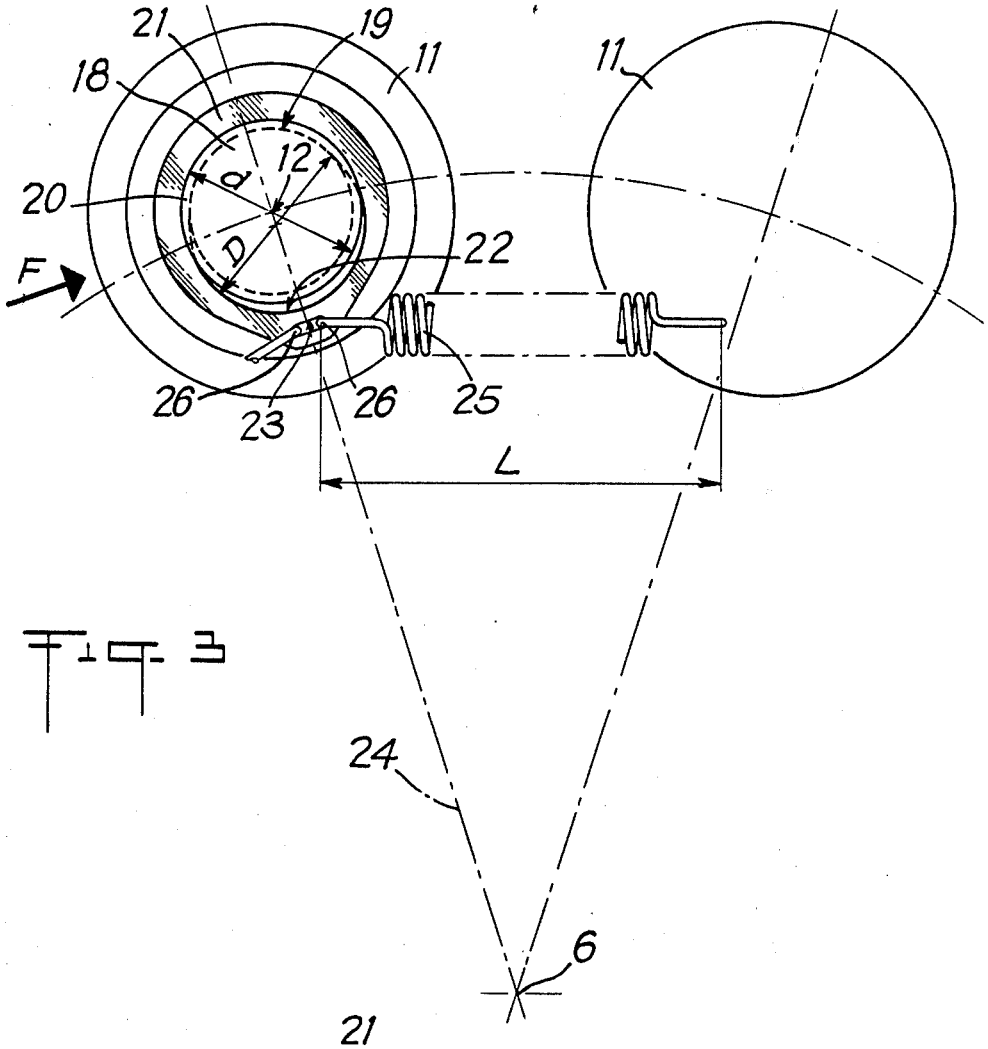
FIG. 3 shows an embodiment feature along arrow G of FIG. 4, of the engine shown in FIGS. 1 and 2; and, FIG. 4 is a view along arrow F of FIG. 3.
Figure 4:
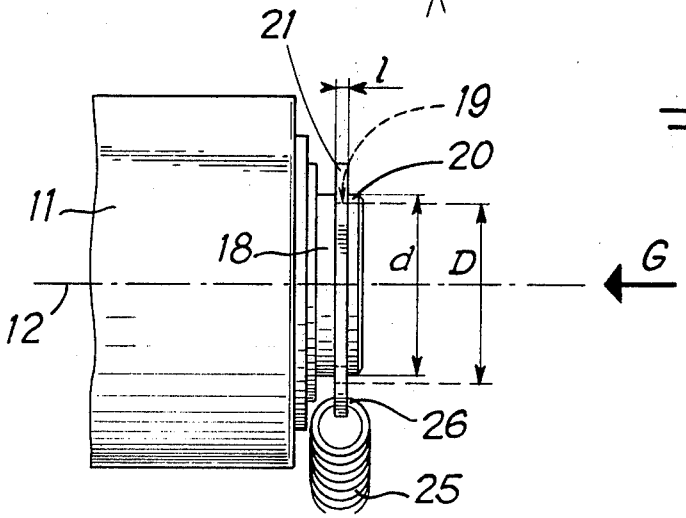

The engine shown comprises:

a casing 1, defining an enclosure, a cam 2, with two tracks, constituted by the inner radial face of the said casing and comprising a plurality of waves 3 regularly angularly spaced apart, a rotary shaft 4, mounted for rotation with respect to the casing 1 by means of rotation bearings 5, about an axis 6, a cylinder block 7, integral in rotation with the shaft 4, a plurality of cylinders 8, provided in the cylinder block 7 and arranged radially with respect to the axis 6 and angularly in regular manner, a plurality of pistons 9, each being slidably mounted in a cylinder 8, a plurality of girders 10, equal in number to the pistons, extending in parallel to the axis 6, each piston 9 being supported by a girder 10, a plurality of rollers 11, mounted in twos, to rotate on the ends of the girders 10, about axes 12 which are parallel to the axis of rotation 6 and in running support on the two tracks of the cam 2, pipes 13, one in each cylinder, provided in the block cylinder 7, each one connecting the inside of the corresponding cylinder to a plane transverse face 14 of the said block a flat seat 15 for distributing the fluid to the various cylinders, which, in known manner, is held so as to be integral in rotation with the casing 1, and is connected to fluid supply and exhaust pipes, diagrammatically illustrated in 17.

Each end of a girder 10 comprises a circular groove 19, delimited towards the outer end of the said girder, by a flange 20 of diameter d. A flat disk 21 provided with a circular opening 22 of diameter D, slightly greater than (or at least equal to) d, and of width l at least equal to, but preferably slightly less than that of the groove 19, is pivotally mounted on the end 18. To this effect, the flange 20 goes through the opening 22 and the upper edge of the said opening is inserted into the groove 19. Thus, each disk 21 can oscillate in the groove 19 in a running movement substantially about the axis 12 of the rollers 11.

Moreover, the lower part of each disk 21 is provided with an oblong hole 23, extending substantially at right angle with the radial plane 24 which crosses the axis 12 of the corresponding rollers.

Finally, a tension spring 25 is coupled between two disks 21 which, in the illustrated example, are two successive disks. Said springs 25 are separate from one another, and are at least equal to the disks 21 by their ends 26 inserted into the holes 23. One hole 23 receives two ends 26 belonging to two separate springs 25.

The following elements should also be noted:

L is the length of a spring 25, when the rollers 11 bear against the cam 2;

when the cylinders 8 are no longer supplied with pressurized fluid, all the pistons are returned towards the axis 6 to their position 9*a*, by means of the springs 25;

to the pisition 9*a* of a piston, corresponds the position 11*a* of the corresponding rollers;

the positions 11*a* of the rollers fit in a cylinder 27 of axis 6, which is offset with respect to the top of the waves 3.

The engine herein described works as follows.

The cylinders 8 are, either fed in pressurized fluid or not.

When the cylinders are fed in pressurized fluid, the two pipes 17 contain the said fluid: the supply pipe 17 contains a highly pressurized (300 bars for example) fluid, the exhaust pipe 17 containing on the contrary a low pressure fluid due to the presence of a low calibration discharge valve fitted on the said pipe, which low pressure fluid is used in known manner as a force-feed fluid whose pressure is low but not nil. The rollers 11 are then held in contact with the cam 2. It can be proved that the total of the lengths of the springs 25 is substantially constant when the rollers 11 run on the cam 2. A simple series of measurements confirms this fact. Consequently, it can be said that the springs, taken altogether, do not work. On the contrary, if each spring were coupled to each one of the pistons in fixed points thereof said spring would work and its length would vary throughout the displacement of the rollers 11 on the cam 2. The free rotation of the disks 21 makes it possible to avoid such variation of the length so that, in addition to the substantial constancy of the total of the lengths of the springs 25, a substantial constancy of the length L of each spring is also obtained. This way, the springs 25 are subjected to virtually no strain and they are not likely to cause any damage through malfunction.

When the cylinders are not fed, the springs 25 return the pistons to the retracted position 9*a*. In this configuration, the springs of course have a constant length and do not work. Evidently, the rollers 11*a* inscribed in the circle 27 do not interfere with either cam 2 or its waves 3.

Also to be noted is the simplicity of the arrangement: flat disks 21 provided with a circular opening 22 and with a hole 23; circular grooves 19 on the end of the girders 10, and simple draw-springs. In addition, the arrangement takes little room.

The invention is not limited to the embodiment shown therein, but on the contrary covers any variant which may be made thereto without departing from its scope or its spirit.

What is claimed is:

1. A pressurized fluid engine comprising a cam surface having a wavelike configuration;

a cylinder block mounted to rotate about an axis with respect to said cam surface and including a plurality of cylinders arranged radially therein with respect to the axis of rotation;

a plurality of pistons each slidably mounted in a respective one of said cylinders and adapted to bear against the cam surface under the force of pressurized fluid; and an elastic device for returning said pistons to a retracted position inside their respective cylinders, said device including separate drawing springs at least equal in number to the number of pistons for biasing said pistons to said retracted position and a plurality of levers each mounted to pivot with respect to one piston about an axis parallel to the axis of rotation of the cylinder block, the number of said levers being equal to the number of said springs, and each lever constituting a link between two springs and each spring coupled to two levers.

2. An engine as claimed in claim 1, wherein each spring is coupled to the levers corresponding to two adjacent pistons.

3. An engine as claimed in any one of claims 1 or 2, further comprising girders for supporting the pistons whereby the pistons bear against the cam surface by means of said girders, and rollers mounted to rotate on said girders and adapted to run along said cam surface, wherein circular grooves are provided at the ends of the girders and each said lever is comprised of a disk having an opening with the ends of the girders being inserted into respective ones of said openings so that at least part of each disk bordering its corresponding opening is inserted into one of said grooves.

4. An engine as claimed in claim 3, wherein each disk includes a hole which is separate from the respective opening and which constitutes a hooking means for the ends of the two springs coupled thereto.

5. An engine as claimed in claim 4, wherein each said hole is oblong and extends substantially at right angles to a line extending between the axis of rotation of the cylinder-block and the center of the respective lever.

6. A pressurized fluid engine comprising:

a cam surface having a wavelike configuration;

a cylinder block mounted for rotation about an axis with respect to said cam surface and including a plurality of cylinders arranged radially therein with respect to said axis;

a plurality of pistons, each slidably mounted in a respective one of said cylinders and adapted to bear again the cam surface under the force of pressurized fluid; and an elastic device for returning said pistons to a retracted position within their respective cylinders, said device including a plurality of levers, each mounted to pivot with respect to one of said pistons about an axis parallel to the axis of rotation of the cylinder block, and a plurality of drawing springs for biasing said pistons to said retracted position in the absence of said force of pressurized fluid, the number of said springs being at least equal to the number of pistons and the number of said levers being equal to the number of springs, and each lever constituting a link between two springs and each spring coupled to two levers, whereby said plurality of drawing springs are effectively inoperative during operation of the engine when said plurality of pistons bear against the cam surface under the force of said pressurized fluid.

* * * * *